US009771176B2

(12) United States Patent
Kastanek et al.

(10) Patent No.: US 9,771,176 B2
(45) **Date of Patent: *Sep. 26, 2017**

(54) REINFORCED PACKAGE

(71) Applicant: Graphic Packaging International, Inc., Atlanta, GA (US)

(72) Inventors: Raymond S. Kastanek, Mead, CO (US); Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/217,026

(22) Filed: Jul. 22, 2016

(65) Prior Publication Data

US 2016/0325877 A1 Nov. 10, 2016

Related U.S. Application Data

(63) Continuation-in-part of application No. 14/496,252, filed on Sep. 25, 2014.

(Continued)

(51) Int. Cl.
*B65D 5/60* (2006.01)
*B31B 1/62* (2006.01)

(Continued)

(52) U.S. Cl.
CPC ..... *B65D 5/606* (2013.01); *B65D 5/0227* (2013.01); *B65D 5/3628* (2013.01)

(58) Field of Classification Search
USPC ..... 229/117.34, 117.32, 117.05, 117.3, 229/117.27, 902, 904; 493/99, 100
See application file for complete search history.

(56) References Cited

U.S. PATENT DOCUMENTS 1,474,088 A 11/1923 Reynolds
1,516,090 A 11/1924 Gary et al.

(Continued)

FOREIGN PATENT DOCUMENTS

CA 2 384 311 3/2001
CA 2 586 472 5/2006

(Continued)

OTHER PUBLICATIONS

International Search Report and Written Opinion for PCT/US2014/057385 dated Jan. 30, 2015.

(Continued)

*Primary Examiner* — Christopher Demeree
(74) *Attorney, Agent, or Firm* — Womble Carlyle Sandridge & Rice, LLP

(57) ABSTRACT

A reinforced package comprising a carton comprising a plurality of panels that can comprise a front panel, a first side panel foldably connected to the front panel, a second side panel foldably connected to the front panel, and at least one back panel foldably connected to at least one of the first side panel and the second side panel. A bag can be attached to the carton and can have an at least partially open end, an at least partially closed end, and an interior space for holding a product. The carton can be positionable in a non-erect position wherein the interior space of the bag is at least partially collapsed and in an erect position wherein the interior space of the bag is increased. The carton can support the bag in the erect position and can have retention features for retaining the carton in the erect position.

41 Claims, 7 Drawing Sheets

Related U.S. Application Data

(60) Provisional application No. 62/282,049, filed on Jul. 23, 2015, provisional application No. 61/960,712, filed on Sep. 25, 2013.

(51) Int. Cl.

| | |
|---|---|
| ***B65D 5/72*** | (2006.01) |
| ***B65D 5/36*** | (2006.01) |
| ***B65D 5/02*** | (2006.01) |

(56) References Cited

U.S. PATENT DOCUMENTS

| | | | |
|---|---|---|---|
| 1,664,111 | A | 3/1928 | Johnson |
| 2,092,858 | A | 9/1937 | Richard |
| 2,099,257 | A | 11/1937 | Bergstein |
| 2,107,946 | A | 2/1938 | Inman |
| 2,132,966 | A | 11/1938 | O'Brien |
| 2,166,388 | A | 7/1939 | Bergstein |
| 2,197,133 | A | 4/1940 | Piazze |
| 2,250,249 | A | 7/1941 | Bergstein |
| 2,282,207 | A | 5/1942 | Palmer |
| 2,286,465 | A | 6/1942 | Clement |
| RE23,096 | E | 4/1949 | Mullinix |
| 2,553,923 | A | 5/1951 | Lambert |
| 2,835,435 | A | 5/1958 | Mullinix |
| 2,870,023 | A | 1/1959 | Vogt |
| 2,913,161 | A | 11/1959 | Travis |
| 2,987,402 | A | 6/1961 | Dold |
| 3,142,231 | A | 7/1964 | Christensson |
| 3,142,430 | A | 7/1964 | Meyers |
| 3,194,471 | A | 7/1965 | Murphy |
| 3,240,419 | A | 3/1966 | Spiering et al. |
| 3,249,286 | A | 5/1966 | Palmer |
| 3,250,454 | A | 5/1966 | Steiger |
| 3,272,423 | A | 9/1966 | Bjarno |
| 3,324,998 | A | 6/1967 | Farquhar |
| 3,357,631 | A | 12/1967 | Aid et al. |
| 3,399,818 | A | 9/1968 | Stegner |
| 3,428,235 | A | 2/1969 | Randazzo |
| 3,459,357 | A | 8/1969 | Egger et al. |
| 3,482,758 | A | 12/1969 | Pierre |
| 3,515,333 | A | 6/1970 | Kotkas et al. |
| 3,576,290 | A | 4/1971 | Marchisen |
| 3,627,541 | A | 12/1971 | Farquhar |
| 3,637,130 | A | 1/1972 | Farquhar |
| 3,659,777 | A | 5/1972 | Kanada et al. |
| 3,945,870 | A | 3/1976 | Johnsen |
| 3,964,669 | A | 6/1976 | Sontag et al. |
| 4,011,983 | A | 3/1977 | Greene |
| 4,082,216 | A | 4/1978 | Clarke |
| 4,196,035 | A | 4/1980 | Reil |
| 4,228,945 | A | 10/1980 | Wysocki |
| 4,267,955 | A | 5/1981 | Struble |
| 4,284,205 | A | 8/1981 | Hirata |
| 4,312,451 | A | 1/1982 | Forbes, Jr. |
| 4,313,542 | A | 2/1982 | Roberts et al. |
| 4,398,636 | A | 8/1983 | Baxter |
| 4,457,483 | A | 7/1984 | Gagne |
| 4,477,014 | A | 10/1984 | Brandenburger |
| 4,478,351 | A | 10/1984 | Homma |
| 4,484,683 | A | 11/1984 | Werner, Jr. |
| 4,494,785 | A | 1/1985 | Song |
| 4,575,000 | A | 3/1986 | Gordon et al. |
| 4,754,914 | A | 7/1988 | Wischusen, III |
| 4,775,771 | A | 10/1988 | Pawlowski |
| 4,785,696 | A | 11/1988 | Martiny |
| 4,865,921 | A | 9/1989 | Hollenberg |
| 4,890,439 | A | 1/1990 | Smart |
| 4,919,785 | A | 4/1990 | Willey et al. |
| 4,930,639 | A | 6/1990 | Rigby |
| 4,936,935 | A | 6/1990 | Beckett |
| 4,940,200 | A | 7/1990 | Sawyer |
| 4,963,424 | A | 10/1990 | Beckett |
| 5,028,147 | A | 7/1991 | Graham |
| 5,034,234 | A | 7/1991 | Andreas et al. |
| 5,071,062 | A | 12/1991 | Bradley et al. |
| 5,078,273 | A | 1/1992 | Kuchenbecker |
| 5,080,643 | A | 1/1992 | Mitchell et al. |
| 5,093,364 | A | 3/1992 | Richards |
| 5,096,723 | A | 3/1992 | Turpin |
| 5,117,078 | A | 5/1992 | Beckett |
| 5,132,124 | A | 7/1992 | Tamaki et al. |
| 5,175,404 | A | 12/1992 | Andreas et al. |
| 5,213,902 | A | 5/1993 | Beckett |
| 5,221,419 | A | 6/1993 | Beckett |
| 5,260,537 | A | 11/1993 | Beckett |
| 5,266,386 | A | 11/1993 | Beckett |
| 5,326,022 | A | 7/1994 | Green |
| 5,330,099 | A | 7/1994 | Beales et al. |
| RE34,683 | E | 8/1994 | Maynard |
| 5,337,951 | A | 8/1994 | Roccaforte |
| 5,340,436 | A | 8/1994 | Beckett |
| 5,346,311 | A | 9/1994 | Siler et al. |
| 5,354,973 | A | 10/1994 | Beckett |
| 5,410,135 | A | 4/1995 | Pollart |
| 5,411,165 | A | 5/1995 | Ellis |
| 5,424,517 | A | 6/1995 | Habeger |
| 5,427,267 | A | 6/1995 | Willman |
| 5,484,100 | A | 1/1996 | Rigby |
| 5,492,269 | A * | 2/1996 | Sung ..... B65D 5/3628 229/117.06 |
| 5,510,132 | A | 4/1996 | Gallo, Jr. |
| 5,519,195 | A | 5/1996 | Keefer |
| 5,585,027 | A | 12/1996 | Young |
| 5,615,795 | A | 4/1997 | Tipps |
| 5,628,921 | A | 5/1997 | Beckett |
| 5,672,407 | A | 9/1997 | Beckett |
| 5,688,427 | A | 11/1997 | Gallo, Jr. |
| 5,759,422 | A | 6/1998 | Schmelzer |
| 5,800,724 | A | 9/1998 | Habeger |
| 5,921,681 | A | 7/1999 | Money |
| 5,938,110 | A | 8/1999 | Bernstein |
| 5,964,161 | A | 10/1999 | Conway |
| 6,063,415 | A | 5/2000 | Walters |
| 6,082,613 | A | 7/2000 | Mikulski et al. |
| 6,114,679 | A | 9/2000 | Lai |
| 6,132,351 | A | 10/2000 | Lotto et al. |
| 6,139,662 | A | 10/2000 | Forman |
| 6,150,646 | A | 11/2000 | Lai et al. |
| 6,204,492 | B1 | 3/2001 | Zeng et al. |
| 6,234,384 | B1 | 5/2001 | Capy et al. |
| 6,251,451 | B1 | 6/2001 | Zeng |
| 6,254,519 | B1 | 7/2001 | Toshima |
| 6,335,042 | B1 | 1/2002 | Money |
| 6,349,874 | B1 | 2/2002 | Hill |
| 6,360,941 | B1 | 3/2002 | Larsson |
| 6,401,927 | B1 | 6/2002 | Sorensen et al. |
| 6,414,290 | B1 | 7/2002 | Cole |
| 6,431,365 | B1 | 8/2002 | Money |
| 6,433,322 | B2 | 8/2002 | Zeng et al. |
| 6,455,827 | B2 | 9/2002 | Zeng |
| 6,494,619 | B1 | 12/2002 | Sulpizio |
| 6,552,315 | B2 | 4/2003 | Zeng et al. |
| 6,637,646 | B1 | 10/2003 | Muise et al. |
| 6,677,563 | B2 | 1/2004 | Lai |
| 6,683,289 | B2 | 1/2004 | Whitmore et al. |
| 6,695,202 | B2 | 2/2004 | Miess |
| 6,702,178 | B2 | 3/2004 | Bowers et al. |
| 6,717,121 | B2 | 4/2004 | Zeng |
| 6,744,028 | B2 | 6/2004 | Chisholm et al. |
| 6,765,182 | B2 | 7/2004 | Cole |
| 6,869,387 | B2 | 3/2005 | Post et al. |
| 6,986,920 | B2 | 1/2006 | Forman et al. |
| 7,019,271 | B2 | 3/2006 | Wnek et al. |
| 7,143,930 | B2 | 12/2006 | Money et al. |
| 7,414,230 | B2 | 8/2008 | Fitzwater |
| 7,473,875 | B2 | 1/2009 | Fitzwater |
| 7,510,515 | B2 | 3/2009 | Ichikawa |
| 7,604,155 | B2 | 10/2009 | Bossel et al. |
| 7,667,167 | B2 | 2/2010 | Fitzwater |
| 7,699,214 | B2 | 4/2010 | Mestre et al. |
| 7,819,583 | B2 | 10/2010 | Walker et al. |
| 7,837,606 | B2 | 11/2010 | Tetenborg et al. |

(56) References Cited

U.S. PATENT DOCUMENTS

| | | | | |
|---|---|---|---|---|
| 7,893,389 | B2 | 2/2011 | Fitzwater | |
| 7,913,897 | B2 | 3/2011 | Manaige | |
| 7,938,312 | B2 | 5/2011 | Ford | |
| 7,959,060 | B2 | 6/2011 | Wilson et al. | |
| 7,982,167 | B2 | 7/2011 | Fitzwater | |
| 7,984,844 | B2 | 7/2011 | Jones | |
| 8,013,280 | B2 | 9/2011 | Robison et al. | |
| 8,066,137 | B2 | 11/2011 | Sanfilippo et al. | |
| 8,142,077 | B2 | 3/2012 | Iannelli, II et al. | |
| 8,196,805 | B2 | 6/2012 | Brand et al. | |
| 8,206,033 | B2 | 6/2012 | Sato et al. | |
| 8,226,794 | B2 | 7/2012 | Fogle | |
| 8,309,896 | B2 | 11/2012 | Fitzwater | |
| 8,317,671 | B1 | 11/2012 | Zoeckler | |
| 8,403,819 | B2 | 3/2013 | Zoeckler | |
| 8,403,820 | B2 | 3/2013 | Zoeckler | |
| 8,468,782 | B2 | 6/2013 | Michalsky et al. | |
| 8,474,163 | B2 | 7/2013 | Rubin | |
| 8,500,330 | B2 | 8/2013 | Nomura et al. | |
| 8,672,214 | B2 | 3/2014 | Manaige | |
| 8,727,204 | B2 | 5/2014 | Burke | |
| 9,108,761 | B2 | 8/2015 | Fitzwater et al. | |
| 9,113,648 | B2 | 8/2015 | Burke | |
| 9,156,579 | B2 | 10/2015 | Pinkstone | |
| 9,156,582 | B2 | 10/2015 | Walsh et al. | |
| 9,346,234 | B2 | 5/2016 | Hajek et al. | |
| 9,346,582 | B2 | 5/2016 | Pinkstone | |
| 9,463,896 | B2 | 10/2016 | Fitzwater | |
| 2003/0002755 | A1 | 1/2003 | Kim et al. | |
| 2003/0080120 | A1 | 5/2003 | Whitmore et al. | |
| 2003/0185948 | A1 | 10/2003 | Garwood | |
| 2003/0206997 | A1 | 11/2003 | Winkelman et al. | |
| 2004/0004111 | A1 | 1/2004 | Cardinale | |
| 2004/0101605 | A1 | 5/2004 | Sigel | |
| 2005/0284865 | A1 | 12/2005 | Fogle et al. | |
| 2006/0009339 | A1 | 1/2006 | Sleight et al. | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0191929 | A1 | 8/2006 | Berg, Jr. et al. | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0137222 | A1 | 6/2007 | Kastanek et al. | |
| 2007/0138247 | A1 | 6/2007 | Fitzwater | |
| 2007/0151888 | A1* | 7/2007 | Bossel | B65D 75/008 206/495 |
| 2007/0267466 | A1 | 11/2007 | Brand et al. | |
| 2008/0308614 | A1 | 12/2008 | Fitzwater | |
| 2009/0039077 | A1 | 2/2009 | Fitzwater | |
| 2009/0214142 | A1 | 8/2009 | Bossel et al. | |
| 2010/0046861 | A1 | 2/2010 | Wilcoxen | |
| 2010/0263332 | A1 | 10/2010 | Files et al. | |
| 2011/0017812 | A1* | 1/2011 | Belko | B31B 7/00 229/117.27 |
| 2011/0019942 | A1* | 1/2011 | Piraneo | B31B 21/00 383/104 |
| 2011/0052106 | A1 | 3/2011 | Holmes et al. | |
| 2011/0297680 | A1* | 12/2011 | Howell | B65D 33/2508 220/266 |
| 2012/0224794 | A1 | 9/2012 | Veder | |
| 2013/0068653 | A1 | 3/2013 | Lipinski | |
| 2014/0016882 | A1 | 1/2014 | Fitzwater | |
| 2015/0083789 | A1 | 3/2015 | Fitzwater et al. | |

FOREIGN PATENT DOCUMENTS

| | | | |
|---|---|---|---|
| DE | 1 060 313 | | 6/1959 |
| DE | 203 00 817 | | 4/2003 |
| EP | 1 072 526 | | 1/2001 |
| EP | 1 424 290 | A2 | 6/2004 |
| EP | 1 452 458 | | 9/2004 |
| EP | 1 457 425 | | 9/2004 |
| EP | 1 798 159 | A1 | 6/2007 |
| EP | 1 964 785 | | 9/2008 |
| EP | 2 492 203 | A1 | 8/2012 |
| EP | 2 492 204 | A1 | 8/2012 |
| FR | 2 516 481 | | 5/1983 |
| FR | 2 665 882 | | 2/1992 |
| FR | 2 687 384 | | 8/1993 |
| GB | 2 365 000 | | 2/2002 |
| JP | 2004 224402 | | 8/2004 |
| JP | 2005-320022 | A | 11/2005 |
| JP | 2006-240671 | A | 9/2006 |
| JP | 2010-222050 | A | 10/2010 |
| JP | 2011-168330 | A | 9/2011 |
| JP | 2011-168331 | A | 9/2011 |
| JP | 2011-173640 | A | 9/2011 |
| JP | 2011-189978 | A | 9/2011 |
| JP | 2011-251774 | A | 12/2011 |
| JP | 2012-152901 | | 8/2012 |
| JP | 2012-533487 | | 12/2012 |
| WO | WO 2006/052326 | | 5/2006 |
| WO | WO 2007/067705 | | 6/2007 |
| WO | WO 2007/084525 | A2 | 7/2007 |
| WO | WO 2008/086277 | A2 | 7/2008 |
| WO | WO 2009/023286 | | 2/2009 |
| WO | WO 2011/011283 | A2 | 1/2011 |
| WO | WO 2013/003149 | A | 1/2013 |

OTHER PUBLICATIONS

International Search Report and Written Opinion for PCT/US2016/043520 dated Oct. 28, 2016.

International Search Report and Written Opinion for PCT/US2016/047521 dated Dec. 13, 2016.

Supplementary Partial European Search Report for EP 14 84 9557 dated Mar. 7, 2017.

Supplementary European Search Report for EP 14 84 9557 dated Jun. 7, 2017.

* cited by examiner

REINFORCED PACKAGE

CROSS-REFERENCE TO RELATED APPLICATIONS

This application claims the benefit of U.S. Provisional Patent Application No. 62/282,049, filed Jul. 23, 2015. This application is a continuation-in-part of U.S. patent application Ser. No. 14/496,252, filed Sep. 25, 2014, which claims the benefit of U.S. Provisional Patent Application No. 61/960,712, filed Sep. 25, 2013.

INCORPORATION BY REFERENCE

The disclosures of U.S. Provisional Patent Application No. 62/282,049, filed Jul. 23, 2015, U.S. patent application Ser. No. 14/496,252, filed Sep. 25, 2014, U.S. Provisional Patent Application No. 61/960,712, filed Sep. 25, 2013, U.S. patent application Ser. No. 13/834,820, filed Mar. 15, 2013, and Provisional Patent Application No. 62/231,723 filed Jul. 14, 2015, are hereby incorporated by reference as if presented herein in their entirety and are incorporated by reference for all purposes.

BACKGROUND OF THE DISCLOSURE

The present disclosure generally relates to reinforced packages for holding products and to methods of forming the packages. More specifically, the present disclosure is directed to a package including a bag or liner attached to a carton or blank having features to reinforce the shape of the formed package and allow access to the contents of the package.

Bags or liners, such as paper or plastic bags, traditionally have been used for the packaging and transport of products from bulk materials such as rice or sand to larger items. Bags or liners generally are inexpensive and easy to manufacture and can be formed in different configurations and sizes, and can be used for storage and transport of a wide variety of products. In particular, in the food service industry, bags or liners are frequently used for packaging of prepared food items, such as sandwiches, French fries, cereal, etc. Currently, there is a growing demand for bags or liners or similar packages for use in packaging various products, including sandwiches, French fries, cereal, and other prepared food items, for presentation to consumers. However, it is equally important that the costs of such packages necessarily must be minimized as much as possible. While various packages designs including reinforcing or supporting materials have been developed, often, the manufacture of such specialty bags or liners having reinforcing layers or materials supplied thereto has required multiple stages or operations, which can significantly increase the cost of manufacture of such packages.

SUMMARY OF THE DISCLOSURE

In one aspect, the present disclosure is generally directed to a reinforced package comprising a carton comprising a plurality of panels that extend at least partially around an interior of the carton. The plurality of panels can comprise a front panel, a first side panel foldably connected to the front panel, a second side panel foldably connected to the front panel, and at least one back panel foldably connected to at least one of the first side panel and the second side panel. A bag can be attached to the carton. The bag can have an at least partially open end, an at least partially closed end, and an interior space for holding a product. The carton can be positionable in a non-erect position wherein the interior space of the bag is at least partially collapsed and in an erect position wherein the interior space of the bag is increased. The carton can be configured to support the bag in the erect position and the first side panel, and the second side panel can have retention features for at least partially retaining the carton in the erect position.

In one aspect, the present disclosure is generally directed to the combination of a carton blank and a bag for forming a reinforced package for holding a product. The carton blank can be for forming a carton and can comprise a plurality of panels comprising a front panel, a first side panel foldably connected to the front panel, a second side panel foldably connected to the front panel, and at least one back panel foldably connected to at least one of the first side panel and the second side panel. The bag can comprise an at least partially open end, an at least partially closed end, and an interior space for holding a product. The bag can be at least partially attached to the carton blank. The reinforced package formed from the carton blank and the bag can be positionable in a non-erect position wherein the interior space of the bag is at least partially collapsed and in an erect position wherein the interior space of the bag is increased. The first side panel and the second side panel can have retention features for at least partially retaining the carton formed from the carton blank in the erect position.

In one aspect, the present disclosure is generally directed to a method of forming a reinforced package. The method can comprise obtaining a carton blank at least partially attached to a bag. The carton blank can comprise a plurality of panels comprising a front panel, a first side panel foldably connected to the front panel, a second side panel foldably connected to the front panel, and at least one back panel foldably connected to at least one of the first side panel and the second side panel, and the bag can comprise an at least partially open end, an at least partially closed end, and an interior space for holding a product. The method further can comprise forming an interior of a carton at least partially defined by the plurality of panels by folding the plurality of panels at least partially around the bag. The carton can be positionable in a non-erect position wherein the interior space of the bag is at least partially collapsed and in an erect position wherein the interior space of the bag is increased, the carton can be configured to support the bag in the erect position, and the first side panel, the second side panel have retention features for at least partially retaining the carton in the erect position.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a reinforced package for holding products such as food products or other articles. Packages according to the present disclosure can accommodate articles of any shape. The packages can comprises a bag, liner, or wrap material comprising a relatively flexible material attached to a reinforcing construct comprising a relatively rigid material (e.g., paperboard). The bags or liners can generally be made from a paper, plastic or other stock material and can be attached to the reinforcing construct. In one embodiment, the liners comprise polyethylene material or any other suitable heat-sealable material. The reinforcing construct can be of varying widths and can extend about or over the closed ends of the bags, in some embodiments enclosing such closed ends, and will provide support for the bags upon loading with a product or article or series of articles therein. In some embodiments, the reinforcing construct can be folded with their bags into a configuration supporting the bags in a freestanding, upright and opened condition for ease of loading and ease of use.

Figure 1:
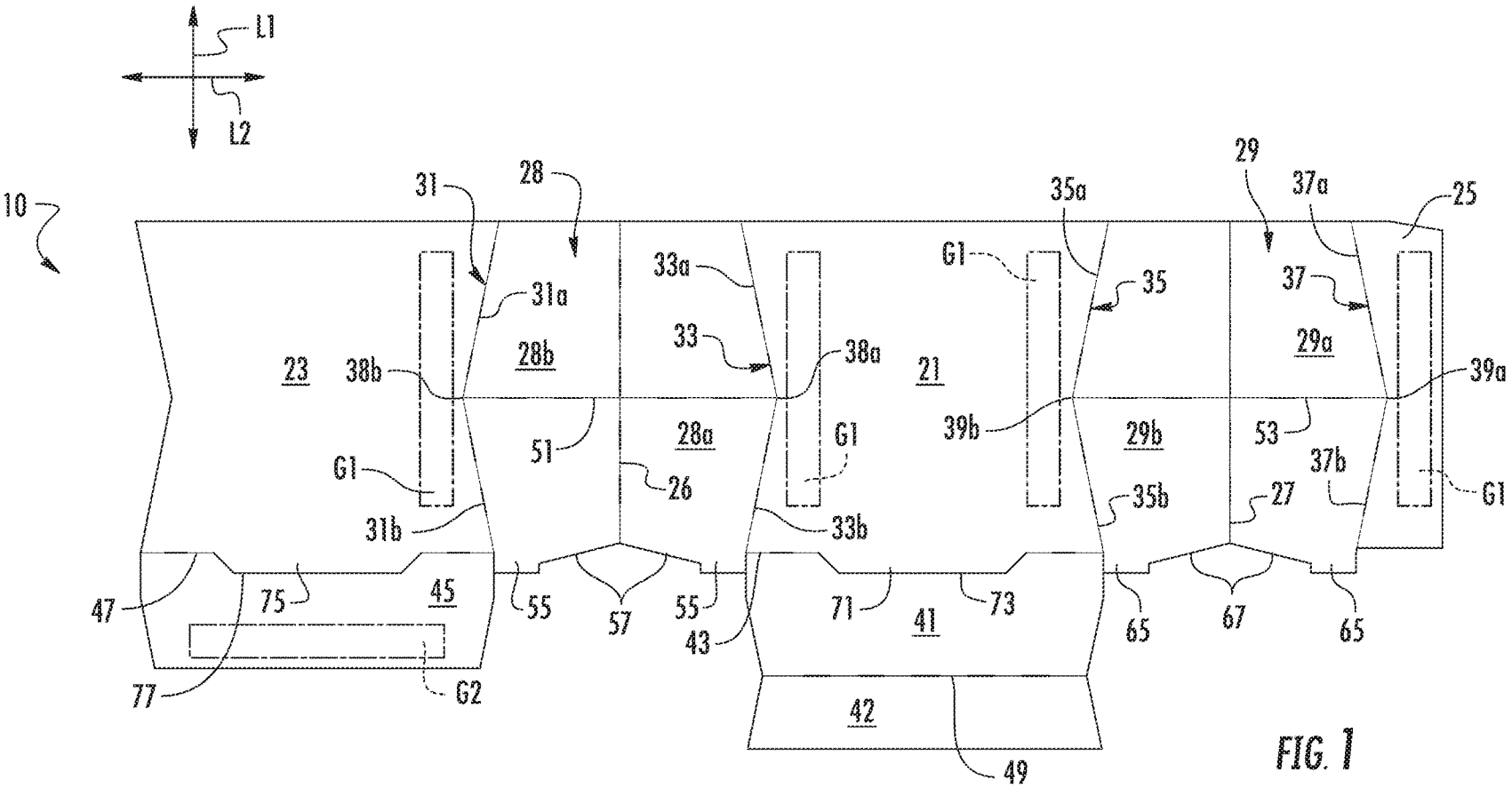
FIG. 1 is an exterior plan view of a blank used to form a carton of a package according to an exemplary embodiment of the disclosure.

FIG. 1 illustrates a blank 10 for forming a reinforced package generally indicated at 1 (FIGS. 4-7), that includes a bag 3 attached to a carton 5 according to one embodiment of the disclosure. The bag has an open top end 7, a closed or sealed bottom end 9, and an interior space 17 for holding a product. In one embodiment, the bag 3 has sealed sides 19 extending the length of the bag between the top 7 and bottom 9. The reinforcing carton 5 can have a bottom 20 that supports the sealed bottom 9 of the bag 3. In the illustrated embodiment, the carton 5 can be positioned in a non-erected or collapsed configuration (FIGS. 4 and 6) and can be positioned an erected or opened configuration (FIGS. 5 and 7) and has retention features as further described herein to reinforce the package 1 by increasing the rigidity of the package and to lock the package in the erected state of FIGS. 5 and 7. Further, the bottom 20 of the carton 5 can have support features for allowing the package 1 to be positioned in the upright position of FIGS. 5 and 7.

As shown in FIG. 1, the blank 10 has a lateral axis L1 and a longitudinal axis L2. In the illustrated embodiment, the blank 10 has a front panel 21 foldably connected to a first side panel 28 at a first fold line 33. The first side panel 28 includes two individual panel portions 28*a*, 28*b* foldably connected to one another at lateral fold line 26. A first back panel 23 is foldably connected to the first side panel 28 at a second fold line 31. A second side panel 29 is foldably connected to the front panel 21 at a third fold line 35. The second side panel 29 includes two individual panel portions 29*a*, 29*b* foldably connected to one another at lateral fold line 27. An attachment flap or second back panel 25 is foldably connected to the second side panel 29 at a fourth fold line 37. The blank 10 includes a bottom panel 41 foldably connected to the front panel 21 at a longitudinal fold line 43. A first bottom end flap 45 is foldably connected to the first back panel 23 at a longitudinal fold line 47. As shown in FIG. 1, a second bottom end flap 42 can be foldably connected to the bottom panel 41 along a longitudinal fold line 49 extending across the width of the bottom end flap. Any of the front panel 21, the back panels 23, 25, the side panels 28, 29, the bottom panel 41, and/or the bottom end flaps 42, 45 could be omitted or could be otherwise arranged, shaped, positioned, and/or configured without departing from the disclosure.

In the illustrated embodiment, the first fold line 33 is segmented into two oblique fold line segments 33*a*, 33*b* extending from a vertex 38*a*. The second fold line 31 is segmented into two oblique fold line segments 31*a*, 31*b* extending from a vertex 38*b*. The third fold line 35 is segmented into two oblique fold line segments 35*a*, 35*b* extending from a vertex 39*a*. The fourth fold line 37 is segmented into two oblique fold line segments 37*a*, 37*b* extending from a vertex 39*b*. The fold lines 33, 31 can be spaced apart from the lateral fold line 26 so that the vertices 38*a*, 38*b* are spaced apart from the lateral fold line 26 farther than the opposite ends of the oblique fold line segments 33*a*, 33*b*, 31*a*, 31*b* (e.g., the panel portions 28*a*, 28*b* and the first side panel 28 are widest between or adjacent the vertices 38*a*, 38*b*). Similarly, the fold lines 37, 35 are spaced apart from the lateral fold line 27 so that the vertices 39*a*, 39*b* are spaced apart from the lateral fold line 27 farther than the opposite ends of the oblique fold line segments 37*a*, 37*b*, 35*a*, 35*b* (e.g., the panel portions 29*a*, 29*b* and the first side panel 29 are widest between or adjacent the vertices 39*a*, 39*b*). The fold lines 33, 31, 37, 35 could be omitted or could be otherwise arranged, shaped, positioned, and/or configured without departing from the disclosure. For example, the fold lines could be arcuate fold lines rather than segmented fold lines as shown.

In one embodiment, the panel portions 28*a*, 28*b* of the first side panel 28 can include a longitudinal fold line 51 extending between the fold lines 31, 33. The panel portions 29*a*, 29*b* of the second side panel 29 include a longitudinal fold line 53 extending between the fold lines 35, 37. As shown in FIG. 1, the longitudinal fold line 51 can extend from the vertex 38*a* of the first fold line 33 to the vertex 38*b* of the second fold line 31 so that the oblique fold line segments 33*a*, 33*b* and 31*a*, 31*b* extend from respective ends of the longitudinal fold line 51. Similarly, the longitudinal fold line 53 can extend from the vertex 39*a* of the fourth fold line 37 to the vertex 39*b* of the third fold line 35 so that the oblique fold line segments 37*a*, 37*b* and 35*a*, 35*b* extend from respective ends of the longitudinal fold line 53. At least the fold lines 31, 33, 35, 37, 51, and 53 comprise the retention features of the blank that can help strengthen and reinforce the package 1 formed from the blank such as by increasing the rigidity of the sides of the carton 5. In one embodiment, the retention features can help retain the carton in the erected position of FIGS. 5 and 7. Any of fold lines 31, 33, 35, 37, 51, 53 and the side panels 28, 29 could be omitted or could be otherwise shaped, arranged, positioned, and/or configured without departing from the disclosure.

Figure 5:
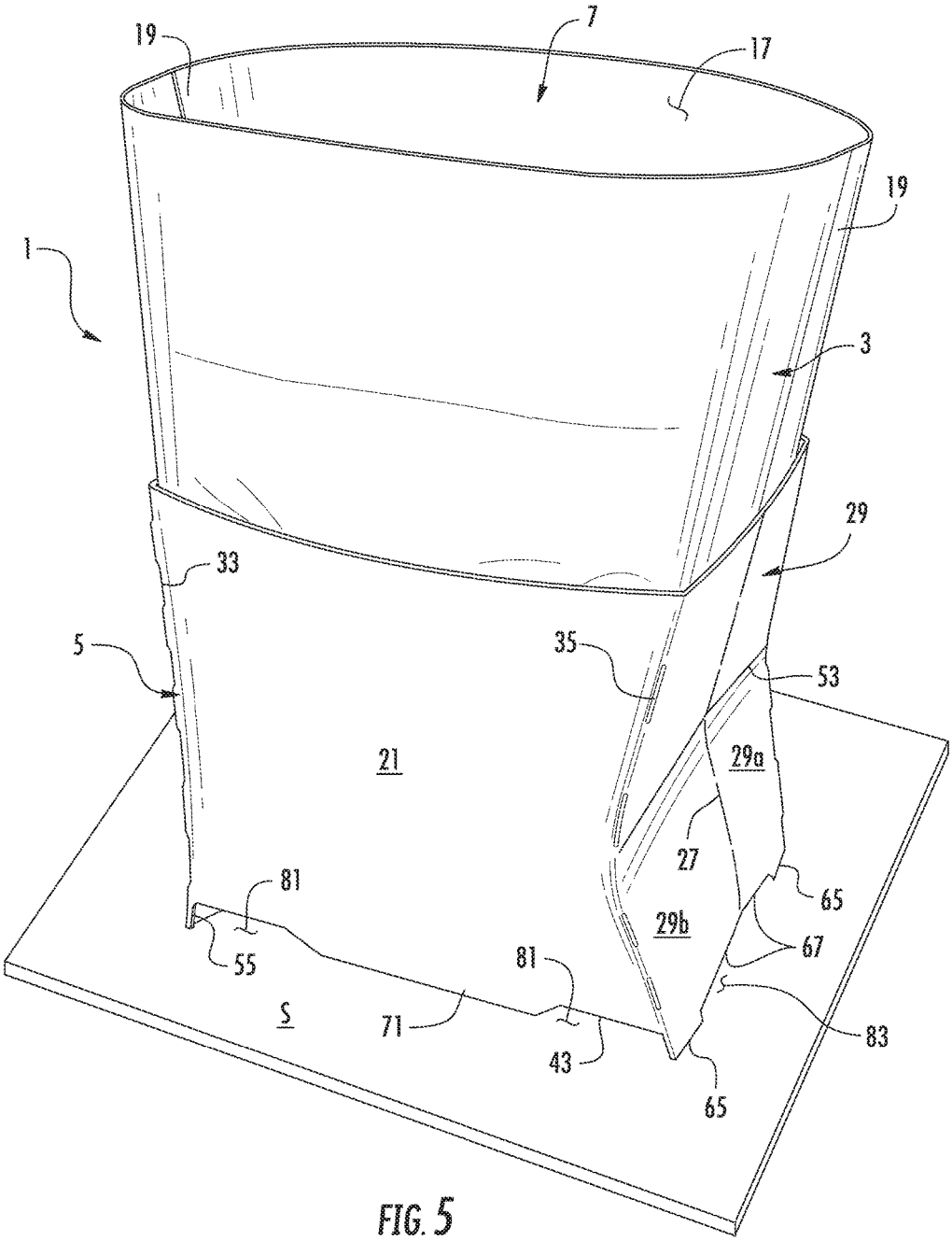
Figure 7:
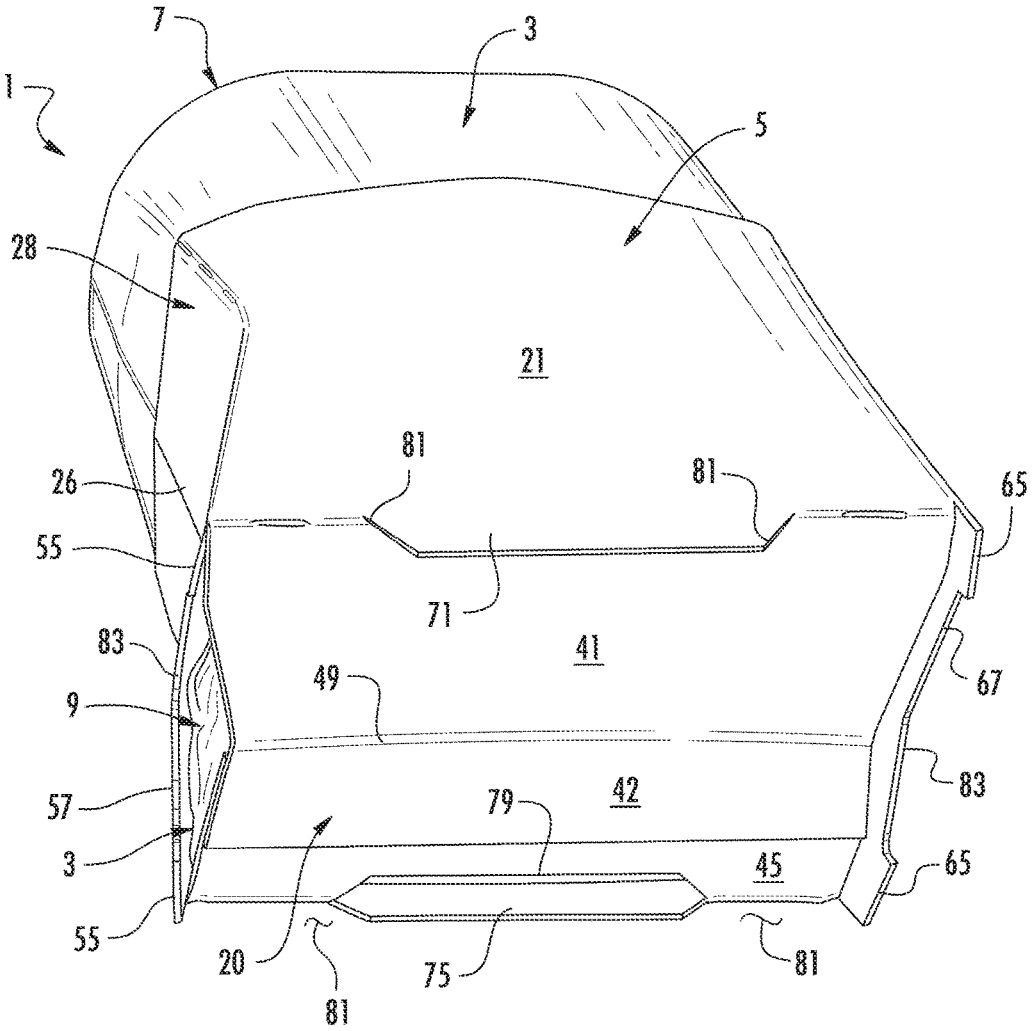
FIG. 7 is a bottom perspective view of the package of FIG. 5 in an erected configuration according to the exemplary embodiment of the disclosure.

In one embodiment, each of the panel portions 28*a*, 28*b* of the side panel 28 includes a lower edge having a support or extension 55 adjacent a respective fold line 31, 33 and an oblique edge 57 extending from the support to the lateral fold line 26. Stated another way, the two oblique edges 57 meet at an end of the lateral fold line 26 and extend from one another to the respective support 55. Similarly, the panel portions 29*a*, 29*b* of the side panel 29 each have a support or extension 65 and oblique edges 67 extending from the support to the lateral fold line 27. Stated another way, the two oblique edges 67 meet at an end of the lateral fold line 27 and extend from one another to the respective support 65. As shown in FIG. 1, the front panel 21 has a support or extension 71 defined by a cut 73 that extends between respective ends of the fold line 43. Similarly, the first back panel 23 has a support or extension 75 that is defined by a cut 77 that extends between respective ends of the fold line 47. The supports 71, 75 can be generally centered on the respective front and back panels 21, 23 in one embodiment. As shown in FIGS. 5 and 7, when the carton 5 is in the erect position, the supports 55, 65, 71, 75 can extend downwardly from the respective side panels 28, 29, front panel 21, and back panel 23 at the bottom 20 of the carton 5. The support features (including supports 55, 65, 71, 75) can help support the formed package 1 on a surface S in an upright position such that the open top end 7 of the bag 3 is accessible to provide access to the interior 17 of the bag (FIG. 5).

Figure 2:
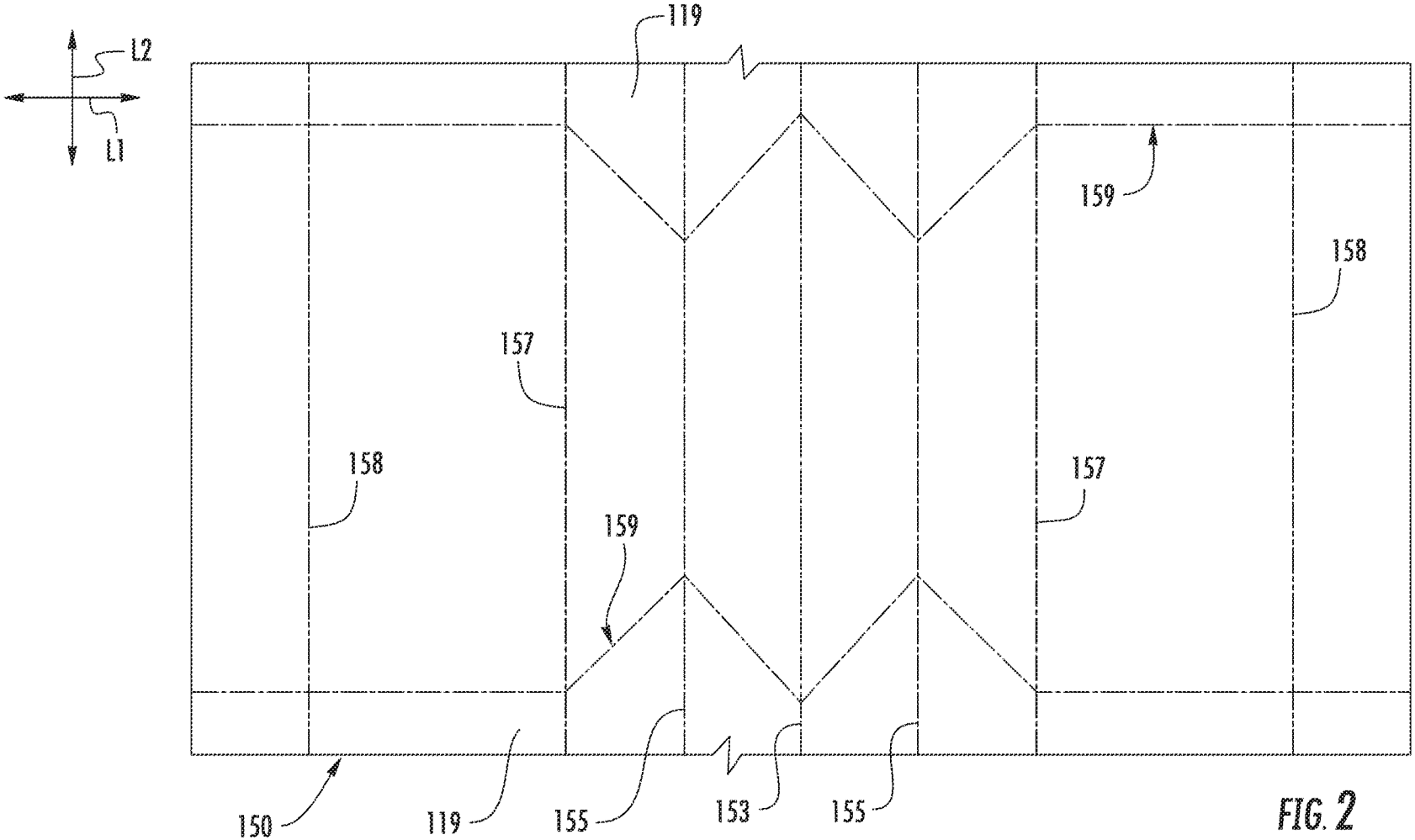
FIG. 2 is a plan view of a portion of a web for forming a bag of the package according to the exemplary embodiment of the disclosure.

In one embodiment, the bag 3 can be formed from similar methods and have similar features as the bag shown in incorporated by reference U.S. Provisional Patent Application No. 62/231,723. The bag can be formed by a portion of suitable material (e.g., a web of material can be folded, sealed, and cut to form the bag). A portion 150 of a web of material is shown schematically in FIG. 2 wherein the lines shown in FIG. 2 illustrate the locations and/or boundaries of certain features in the web portion. These lines may or may not actually be formed in the web portion 150 (e.g., the lines representing the location of folds or the boundary of a seal area may be including in FIG. 2 only to illustrate these features, but may not exist in the web portion, but other lines, such as a fill line, can be printed or otherwise formed on the web portion 150). In one embodiment, the web portion 150 can have a central fold 153 and two outer folds 155 that form the gusseted bottom 9 of the bag 3. When the gusseted bottom 9 of the bag 3 is formed, the web portion 150 is folded along the central fold 153 and the outer folds 155 so that the central fold is disposed between the outer sides of the bag 3. Accordingly, the central fold 153 and the two outer folds 155 form four layers of overlapped material at the bottom of the bag such that the bottom of the bag is expandable for moving from the non-erected position of the package 1 (FIGS. 4 and 6) to the erected position (FIGS. 5 and 7) and/or to accommodate various sizes of product to be held in the bag. The upper boundaries of the bottom gusset 9 are represented by lines 157 in FIG. 2. The bottom gusset 9 could be otherwise shaped, arranged, positioned, and/or configured without departing from the disclosure.

Figure 3:
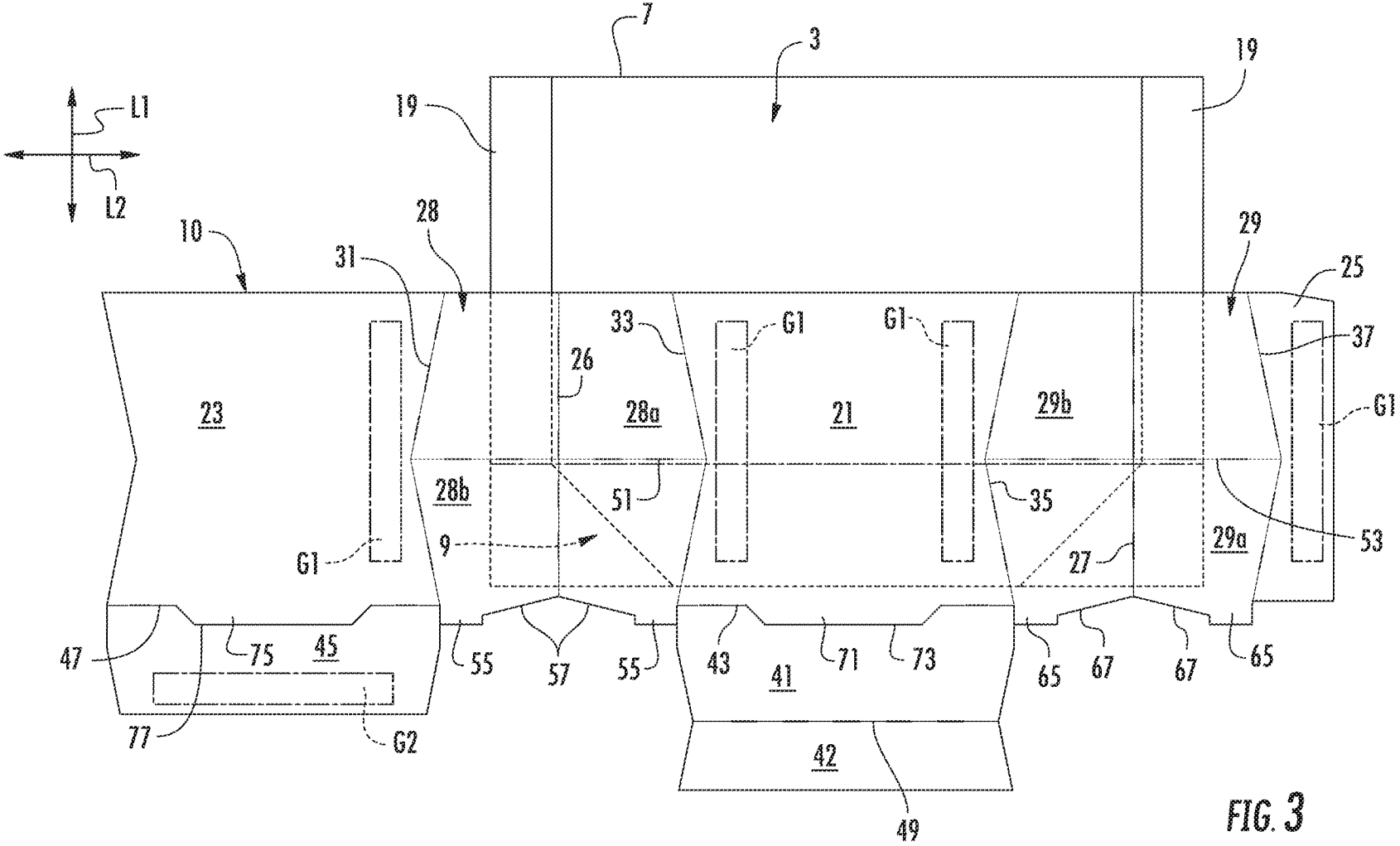
FIG. 3 is an exterior plan view showing the bag formed from the web portion of FIG. 2 attached to the carton blank of FIG. 1.

As shown in FIG. 2, the web portion 150 can include two seal areas 119 extending along the edge margins of the web portion. The boundaries of the seal areas can be represented by respective lines 159. As shown in FIG. 3, after the web portion 150 is folded and the gusseted bottom 9 is formed, seal areas 119 can be heat sealed to form respective heat sealed sides 19 that extend along the sides of the bag 3 into the bottom gusset 9 of the bag. Accordingly, the side portions of the overlapped layers of material along the edge margins and in the bottom of the bag are sealed. In the flat configuration of the bag 3 (e.g., FIG. 3), the outer folds 155 form the lowermost edge of the bag. Optionally, fill lines 158 (FIG. 2) can be printed or otherwise formed on the sides of the web portion 150 to indicate a recommended stopping point for a product (e.g., water) that could be poured into the bag 3. The web portion 150 and/or the bag 3 could be otherwise shaped, arranged, and/or configured without departing from the disclosure.

In one embodiment, the reinforced package 1 can be formed by a packaging system that attaches the web of material for forming the bags 3 to respective blanks 10, and the blanks and web move through a respective packaging system and are formed into the individual packages by various portions and components of the system. In another embodiment, the reinforced package 1 can be formed by similar systems and methods as shown in the incorporated by reference U.S. Provisional Patent Application No. 62/231,723, wherein the bags 3 can be at least partially formed and then attached to the respective blanks 10 and the blanks and web can be moved through a respective packaging system and formed into the individual packages by various portions and components of the system. The reinforced package 1 could be otherwise formed without departing from the disclosure.

In one embodiment, the material for forming the bags 3 can include preprinted paper, polyethylene or other material including flexible and heat-sealable materials. The sealed side portions 19 of each bag 3 are formed by bonding (e.g., heat sealing such as by a rotary heat sealer) the overlapped edge margins 119 of the web of material 150. The bags 3 can be attached to the respective blanks 10 by glue. For example, the bag 3 can be attached to the front panel 21 of the blank 3 at glue strips G1. The bag 3 could be otherwise formed and/or attached to the blank 10 without departing from the disclosure.

In one embodiment, the individual blanks 10 with attached bags 3 are conveyed in the system to a folder/gluer carton forming assembly that includes a series of folders that position the various flaps and panels of the blank 10 to form the flat cartons 5 that can be packaged and shipped for filling with product. In one embodiment, the blank 10 can be folded along lateral fold lines 26, 27 so that the panel portions 28*b*, 29*a* at least partially overlap the respective panel portions 28*a*, 29*b* and the second back panel 25 is overlapped with the first back panel 23 and adhesively attached thereto. As shown in FIGS. 1 and 3, the back panels 23, 25 can include glue strips G1 so that they are glued to the bag 3 when they are folded over the bag. In the illustrated embodiment, the first bottom end flap 45 is overlapped with the second bottom end flap 42 and adhesively attached thereto (e.g., with a glue strip G2, FIGS. 1 and 3) to form the closed bottom 20 of the carton (FIGS. 6 and 7).

Figure 4:
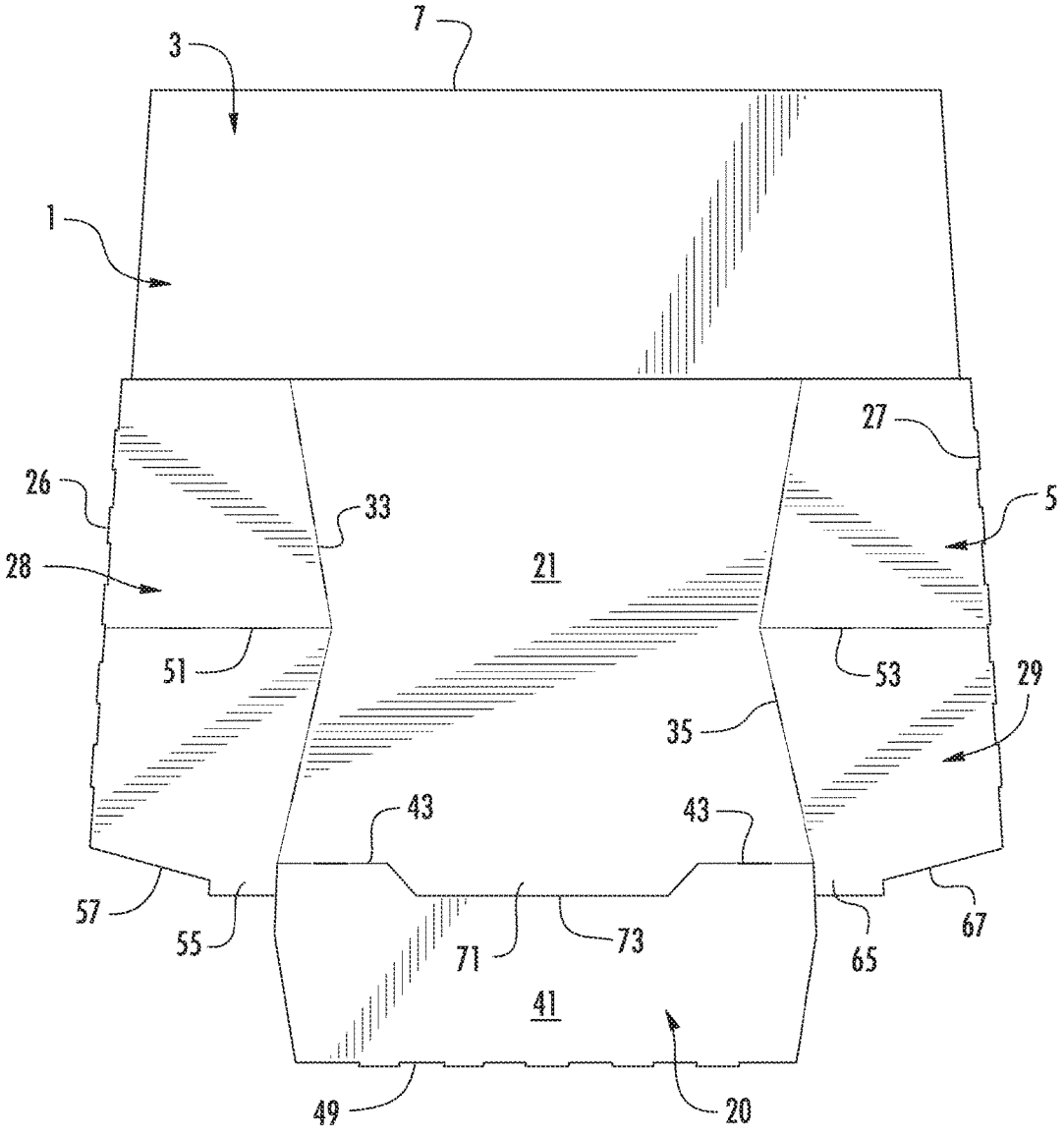
FIGS. 4 and 5 are views of the package formed from the carton blank and bag of FIG. 3 according to the exemplary embodiment of the disclosure.
Figure 6:
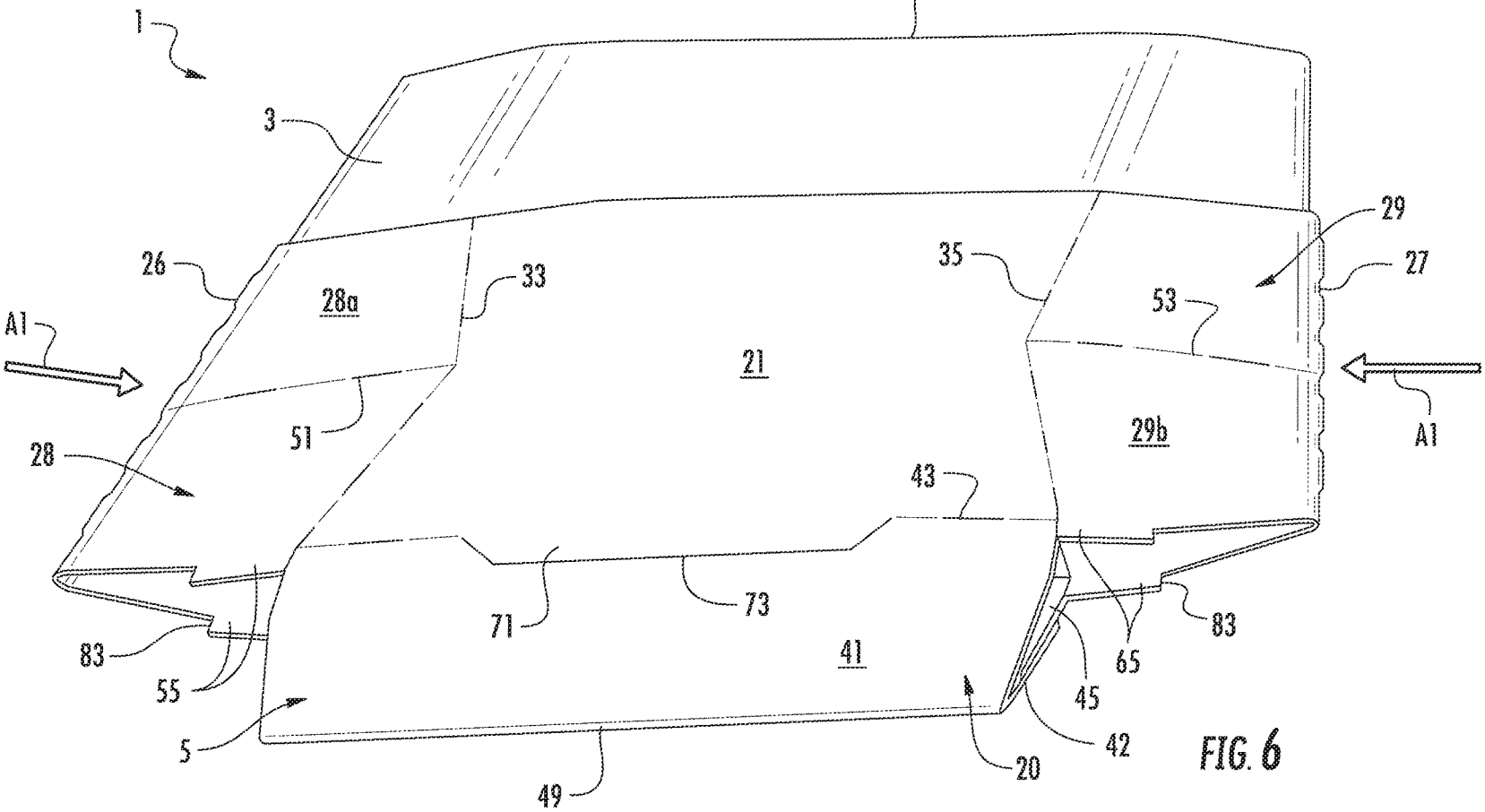
FIG. 6 is a perspective view of the package of FIG. 4 in a collapsed configuration according to the exemplary embodiment of the disclosure.

As shown in FIGS. 4 and 6, in the flat configuration or the non-erected position of the package 1, the carton 5 is folded flat by folding the side panels 28, 29 along fold lines 26, 27 so that the panel portions 28*a*, 28*b* overlap one another and the panel portions 29*a*, 29*b* overlap one another. Additionally, the bottom 20 of the carton 5 is folded outwardly at fold lines 49, 43, 47. In an alternative embodiment, the bottom 20 could be configured for being folded inwardly when the carton is in the non-erected position. The package 1 can be positioned to the erected configuration shown in FIGS. 5 and 7 by grasping the sides 28, 29 and pushing the sides inwardly at fold lines 26, 27 in the direction of arrows A1 (FIG. 6), causing the front panel 21 and back panel 23 to separate or move away from each other to give the package its three dimensional shape and form the interior space 17 of the bag 3 for holding a product. As the panels 21, 23 move apart, the bottom 20 can fold along fold lines 43, 47, 49 so that the bottom panel 41 and the bottom flaps 42, 45 extend across the bottom of the carton from the front panel 21 to the back panel 23. Since the bag 3 is attached to the front and back panels 21, 23, the sides of the bag 3 can be pulled apart as the front and back panels separate from one another. Accordingly, the gusseted bottom 9 of the bag can expand to extend across the bottom of the package 1, supported by the bottom 20 of the carton. In one embodiment, as the bottom panel 41 and the bottom flaps 42, 45 fold to extend across the bottom of the carton, the supports 71, 75 can separate from the respective bottom panel 41 and bottom flap 45 along the respective cuts 73, 77 so that the supports continue to extend from and be coplanar with the respective front panel 21 and back panel 23. The supports 71, 75 can form respective openings 79 in the respective bottom panel 41 and bottom end flap 45 (FIG. 7). The package 1 could be otherwise moved between the erected position and the collapsed position without departing from the disclosure.

In the erected configuration of the package 1 (FIGS. 5 and 7), the supports 55, 65, 71, 75 extend downwardly from the respective side panels 28, 29, front panel 21, and back panel 23 to form the lowermost portion of the bottom 20 of the carton 5. Accordingly, the package 1 can be supported on a flat surface at the supports 55, 65, 72, 75 and positioned upright in the erect configuration to allow access to the interior space 17 through the top 7 of the bag 3. As shown in FIGS. 5-7, recesses 81 can be formed on either side of the supports 71, 75 so that a recess 81 extends between each of the supports 71, 75 and a respective one of the supports 55, 65. In one embodiment, each of the recesses 81 is defined by an edge of one of the supports 71, 75, one of the fold lines 43, 47, and an edge of one of the supports 55, 65. Similarly, a recess 83 can extend between the supports 55 and between the supports 65 so that each of the recesses 83 is defined by the respective edges of the supports 55 or 65 and the respective oblique edges 57, 67.

In one embodiment, the sealed bottom 9 of the bag 3 can be a water-tight seal that allows a user to add water or milk to the interior 17 of the bag of the reinforced package 1 to combine with a food product (e.g., cereal, oatmeal, etc.) in the interior. The package 1 can be placed in a microwave oven to heat the food product without departing from the disclosure. Further, the package 1 can be used to hold other types of food products without departing from the disclosure.

The fold lines 51, 26 in the side panel 28 and the fold lines 53, 27 in the side panel 29 increase the rigidity of the formed package 1. The side panels 28, 29 can fold along the fold lines 51, 26; 53, 27 to bow inward to reinforce the structure of the carton 5 so that the package 1 is urged to stay in the erected configuration once formed. The package 1, carton 5, and/or blank 10 could have other features, or be otherwise shaped, arranged, and/or configured without departing from the disclosure.

Generally, as described herein, liners or bags can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A reinforced package, comprising:

a carton comprising a plurality of panels that extend at least partially around an interior of the carton, the plurality of panels comprising a front panel, a first side panel foldably connected to the front panel along a first fold line, a second side panel foldably connected to the front panel, and at least one back panel foldably connected to at least the first side panel along a second fold line; and a bag attached to the carton, the bag having an at least partially open end, an at least partially closed end, and an interior space for holding a product;

wherein the carton is positionable in a non-erect position wherein the interior space of the bag is at least partially collapsed and in an erect position wherein the interior space of the bag is increased, the carton is configured to support the bag in the erect position, and one or more of the first side panel and the second side panel have retention features for at least partially retaining the carton in the erect position, the retention features comprising the first fold line, the second fold line, and a longitudinal fold line extending in the first side panel from the first fold line to the second fold line, the longitudinal fold line being spaced from a bottom end of the carton.

2. The reinforced package of claim 1, wherein the longitudinal fold line is a first longitudinal fold line, the second side panel is foldably connected to the front panel along a third fold line and is foldably connected to the at least one back panel along a fourth fold line, the retention features further comprising the third fold line, the fourth fold line, and a second longitudinal fold line extending in the second side panel from the third fold line to the fourth fold line.

3. The reinforced package of claim 1, wherein each of the first fold line and the second fold line comprises two oblique portions extending from a respective first vertex and second vertex, the first vertex and the second vertex extends into the respective front panel and at least one back panel, and the longitudinal fold line extends from the first vertex to the second vertex.

4. The reinforced package of claim 1, wherein the first side panel comprises a first panel portion foldably connected to a second panel portion along a lateral fold line extending in the first side panel, the first panel portion and the second panel portion being folded along the lateral fold line to at least partially overlap one another in the non-erect position.

5. A reinforced package, comprising:

a carton comprising a plurality of panels that extend at least partially around an interior of the carton, the plurality of panels comprising a front panel, a first side panel foldably connected to the front panel, a second side panel foldably connected to the front panel, and at least one back panel foldably connected to at least one of the first side panel and the second side panel; and a bag attached to the carton, the bag having an at least partially open end, an at least partially closed end, and an interior space for holding a product;

wherein the carton is positionable in a non-erect position wherein the interior space of the bag is at least partially collapsed and in an erect position wherein the interior space of the bag is increased, the carton is configured to support the bag in the erect position, and the first side panel and the second side panel have retention features for at least partially retaining the carton in the erect position, wherein the carton further comprises a bottom wall comprising a bottom panel and a bottom flap each foldably connected to at least one of the front panel and the at least one back panel.

6. The reinforced package of claim 5, wherein the bottom wall is folded outwardly with respect to the front panel and the at least one back panel when the carton is in the non-erect position.

7. The reinforced package of claim 5, wherein the bottom flap comprises a first bottom flap, the bottom wall comprises a second bottom flap foldably connected to the bottom panel along a fold line, the second bottom flap being at least partially adhered to the first bottom flap, and the bottom wall is folded along the fold line so that the first bottom flap and the bottom panel at least partially overlap one another when the carton is in the non-erect position.

8. The reinforced package of claim 7, wherein the fold line is spaced apart from the front panel and the at least one back panel in the non-erect position.

9. A reinforced package, comprising:

a carton comprising a plurality of panels that extend at least partially around an interior of the carton, the plurality of panels comprising a front panel, a first side panel foldably connected to the front panel, a second side panel foldably connected to the front panel, and at least one back panel foldably connected to at least one of the first side panel and the second side panel; and a bag attached to the carton, the bag having an at least partially open end, an at least partially closed end, and an interior space for holding a product;

wherein the carton is positionable in a non-erect position wherein the interior space of the bag is at least partially collapsed and in an erect position wherein the interior space of the bag is increased, the carton is configured to support the bag in the erect position, and the first side panel and the second side panel have retention features for at least partially retaining the carton in the erect position; and wherein the carton further comprises support features extending from at least one panel of the plurality of panels, the support features comprising at least a first support and a second support respectively extending from at least one of the front panel, the at least one back panel, the first side panel, and the second side panel.

10. The reinforced package of claim 9, wherein the first support extends downwardly from the front panel and the second support extends downwardly from the at least one back panel.

11. The reinforced package of claim 10, wherein the carton further comprises a bottom panel foldably connected to the front panel and a bottom flap foldably connected to the at least one back panel, the first support extends adjacent to a first opening in the bottom panel, and the second support extends adjacent to a second opening in the bottom flap.

12. The reinforced package of claim 11, wherein the support features comprise at least one side support extending downwardly from each of the first side panel and the second side panel.

13. The reinforced package of claim 9, wherein the first support extends downwardly from the first side panel and the second support extends downwardly from the second side panel.

14. The reinforced package of claim 13, wherein each of the first side panel and the second side panel comprises an oblique edge extending from the respective first support and second support.

15. The reinforced package of claim 9, wherein the first side panel comprises a first panel portion foldably connected to a second panel portion along a first lateral fold line extending in the first side panel, and the first support extends from the first panel portion and the second support extends from the second panel portion.

16. The reinforced package of claim 15, wherein the first panel portion comprises a first oblique edge and the second panel portion comprises a second oblique edge, the first oblique edge extending from an end of the first lateral fold line to the first support and the second oblique edge extending from the end of the first lateral fold line to the second support, the first support, the first oblique edge, the second oblique edge, and the second support at least partially defining a recess in the first side panel.

17. The reinforced package of claim 15, wherein the support features further comprise a front support extending from the front panel and a back support extending from the at least one back panel, the first support being spaced apart from the second support by a first recess in the first side panel, the front support being spaced apart from the first support by a second recess in the front panel, and the back support being spaced apart from the second support by a third recess in the at least one back panel.

18. The reinforced package of claim 15, wherein the second side panel comprises a third panel portion foldably connected to a fourth panel portion along a second lateral fold line extending in the second side panel, and the support features further comprise a third support extending from the third panel portion and a fourth support extending from the fourth panel portion.

19. The reinforced package of claim 18, wherein the first side panel comprises a first recess extending between the first support and the second support and the second side panel comprises a second recess extending between the third support and the fourth support.

20. In combination, a carton blank and a bag for forming a reinforced package for holding a product:

the carton blank being for forming a carton, the carton blank comprising a plurality of panels comprising a front panel, a first side panel foldably connected to the front panel along a first fold line, a second side panel foldably connected to the front panel, and at least one back panel foldably connected to at least the first side panel along a second fold line;

the bag comprising an at least partially open end, an at least partially closed end, and an interior space for holding a product, the bag being at least partially attached to the carton blank;

wherein the reinforced package formed from the carton blank and the bag is positionable in a non-erect position wherein the interior space of the bag is at least partially collapsed and in an erect position wherein the interior space of the bag is increased, and the first side panel and the second side panel have retention features for at least partially retaining the carton formed from the carton blank in the erect position, the retention features comprising the first fold line, the second fold line, and a longitudinal fold line extending in the first side panel from the first fold line to the second fold line, the longitudinal fold line being spaced apart from a bottom end of the carton blank.

21. The combination of claim 20, wherein the longitudinal fold line is a first longitudinal fold line, the second side panel is foldably connected to the front panel along a third fold line and is foldably connected to the at least one back panel along a fourth fold line, the retention features further comprising the third fold line, the fourth fold line, and a second longitudinal fold line extending in the second side panel from the third fold line to the fourth fold line.

22. The combination of claim 20, wherein each of the first fold line and the second fold line comprises two oblique portions extending from a respective first vertex and second vertex, the first vertex and the second vertex extends into the respective front panel and at least one back panel, and the longitudinal fold line extends from the first vertex to the second vertex.

23. The combination of claim 20, wherein the first side panel comprises a first panel portion foldably connected to a second panel portion along a lateral fold line extending in the first side panel, the first panel portion and the second panel portion being folded along the lateral fold line to at least partially overlap one another in the non-erect position when the reinforced package is formed from the carton blank and the bag.

24. In combination, a carton blank and a bag for forming a reinforced package for holding a product:

the carton blank being for forming a carton, the carton blank comprising a plurality of panels comprising a front panel, a first side panel foldably connected to the front panel, a second side panel foldably connected to the front panel, and at least one back panel foldably connected to at least one of the first side panel and the second side panel, and the bag comprising an at least partially open end, an at least partially closed end, and an interior space for holding a product, the bag being at least partially attached to the carton blank;

wherein the reinforced package formed from the carton blank and the bag is positionable in a non-erect position wherein the interior space of the bag is at least partially collapsed and in an erect position wherein the interior space of the bag is increased, the first side panel and the second side panel have retention features for at least partially retaining the carton formed from the carton blank in the erect position, and the carton blank further comprises a bottom panel and a bottom flap each foldably connected to at least one of the front panel and the at least one back panel, the bottom panel and the bottom flap at least partially forming a bottom wall in the carton formed from the carton blank.

25. The combination of claim 24, wherein the bottom wall is for being folded outwardly with respect to the front panel and the at least one back panel when the carton is in the non-erect position when the reinforced package is formed from the carton blank and the bag.

26. The combination of claim 24, wherein the bottom flap comprises a first bottom flap, the carton blank comprises a second bottom flap foldably connected to the bottom panel along a fold line, the second bottom flap is for being at least partially adhered to the first bottom flap when the carton is formed from the carton blank, and the bottom wall is for being folded along the fold line so that the first bottom flap and the bottom panel at least partially overlap one another when the carton is in the non-erect position when the reinforced package is formed from the carton blank and the bag.

27. In combination, a carton blank and a bag for forming a reinforced package for holding a product:

the carton blank being for forming a carton, the carton blank comprising a plurality of panels comprising a front panel, a first side panel foldably connected to the front panel, a second side panel foldably connected to the front panel, and at least one back panel foldably connected to at least one of the first side panel and the second side panel; and the bag comprising an at least partially open end, an at least partially closed end, and an interior space for holding a product, the bag being at least partially attached to the carton blank;

wherein the reinforced package formed from the carton blank and the bag is positionable in a non-erect position wherein the interior space of the bag is at least partially collapsed and in an erect position wherein the interior space of the bag is increased, the first side panel and the second side panel have retention features for at least partially retaining the carton formed from the carton blank in the erect position, and wherein the carton blank further comprises support features extending from at least one panel of the plurality of panels, the support features comprising at least a first support and a second support respectively extending from at least one of the front panel, the at least one back panel, the first side panel, and the second side panel.

28. The combination of claim 27, wherein the first support extends from the front panel and the second support extends from the at least one back panel.

29. The combination of claim 28, wherein the carton blank further comprises a bottom panel foldably connected to the front panel and a bottom flap foldably connected to the at least one back panel, the first support is at least partially separable from the bottom panel along a first cut line, and the second support is at least partially separable from the bottom flap along a second cut line.

30. The combination of claim 29, wherein the support features comprise at least one side support extending from each of the first side panel and the second side panel.

31. The combination of claim 27, wherein the first support extends from the first side panel and the second support extends from the second side panel.

32. The combination of claim 31, wherein each of the first side panel and the second side panel comprises an oblique edge extending from the respective first support and second support.

33. The combination of claim 27, wherein the first side panel comprises a first panel portion foldably connected to a second panel portion along a first lateral fold line extending in the first side panel, and the first support extends from the first panel portion and the second support extends from the second panel portion.

34. The combination of claim 33, wherein the first panel portion comprises a first oblique edge and the second panel portion comprises a second oblique edge, the first oblique edge extending from an end of the first lateral fold line to the first support and the second oblique edge extending from the end of the first lateral fold line to the second support, the first support, the first oblique edge, the second oblique edge, and the second support at least partially defining a recess in the first side panel.

35. The combination of claim 33, wherein the second side panel comprises a third panel portion foldably connected to a fourth panel portion along a second lateral fold line extending in the second side panel, and the support features further comprise a third support extending from the third panel portion and a fourth support extending from the fourth panel portion.

36. The combination of claim 35, wherein the first side panel comprises a first recess extending between the first support and the second support and the second side panel comprises a second recess extending between the third support and the fourth support.

37. A method of forming a reinforced package comprising:

obtaining a carton blank at least partially attached to a bag, the carton blank comprising a plurality of panels comprising a front panel, a first side panel foldably connected to the front panel along a first fold line, a second side panel foldably connected to the front panel, and at least one back panel foldably connected to at least the first side panel along a second fold line, and the bag comprising an at least partially open end, an at least partially closed end, and an interior space for holding a product;

forming an interior of a carton at least partially defined by the plurality of panels by folding the plurality of panels at least partially around the bag;

wherein the carton is positionable in a non-erect position wherein the interior space of the bag is at least partially collapsed and in an erect position wherein the interior space of the bag is increased, and the carton is configured to support the bag in the erect position, and the first side panel, the second side panel have retention features for at least partially retaining the carton in the erect position, the retention features comprising the first fold line, the second fold line, and a longitudinal fold line extending in the first side panel from the first fold line to the second fold line, the longitudinal fold line being spaced from a bottom end of the carton.

38. The method of claim 37, wherein the first side panel comprises a first panel portion foldably connected to a second panel portion along a first lateral fold line extending in the first side panel, the second side panel comprises a third panel portion foldably connected to a fourth panel portion along a second lateral fold line extending in the second side panel, and the folding the plurality of panels comprises folding the second panel portion and the fourth panel portion along the respective first lateral fold line and the second lateral fold line so that the second panel portion at least partially overlaps the first panel portion, the fourth panel portion at least partially overlaps the third panel portion, and the at least one back panel at least partially overlaps the bag.

39. The method of claim 37, wherein the first side panel comprises a first panel portion foldably connected to a second panel portion along a lateral fold line extending in the first side panel, and the first panel portion is foldably connected to the front panel along the first fold line, the second panel portion is foldably connected to the at least one back panel along the second fold line.

40. A method of forming a reinforced package comprising:

obtaining a carton blank at least partially attached to a bag, the carton blank comprising a plurality of panels comprising a front panel, a first side panel foldably connected to the front panel, a second side panel foldably connected to the front panel, at least one back panel foldably connected to at least one of the first side panel and the second side panel, a first support extending from the front panel, a second support extending from the at least one back panel, a bottom panel foldably connected to the front panel, and a bottom end flap foldably connected to the at least one back panel;

the bag comprising an at least partially open end, an at least partially closed end, and an interior space for holding a product;

forming an interior of a carton at least partially defined by the plurality of panels by folding the plurality of panels at least partially around the bag;

wherein the carton is positionable in a non-erect position wherein the interior space of the bag is at least partially collapsed and in an erect position wherein the interior space of the bag is increased, and the carton is configured to support the bag in the erect position, and the first side panel, the second side panel have retention features for at least partially retaining the carton in the erect position;

the method further comprises forming a bottom wall of the carton, the bottom wall comprising at least the bottom panel and the bottom flap; and moving the carton from the non-erect position to the erect position comprises folding the bottom panel and the bottom flap with respect to the respective front panel and at least one back panel so that the bottom wall extends at least partially across a bottom of the carton in the erect position, the first support at least partially separating from the bottom panel along a first cut line and the second support at least partially separating from the bottom flap along a second cut line during the folding the bottom panel and the bottom flap.

41. The method of claim 40, wherein the carton blank further comprises at least one side support extending from each of the first side panel and the second side panel.

* * * * *